US009527292B2

(12) United States Patent
Katsuki

(10) Patent No.: US 9,527,292 B2
(45) Date of Patent: Dec. 27, 2016

(54) WASTE INK RECOVERY UNIT, PRINTER, AND WASTE INK RECOVERY METHOD

(71) Applicant: Seiko Epson Corporation, Tokyo (JP)

(72) Inventor: Kiyoteru Katsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/830,456

(22) Filed: Aug. 19, 2015

(65) Prior Publication Data

US 2016/0052277 A1 Feb. 25, 2016

(30) Foreign Application Priority Data

Aug. 22, 2014 (JP) ..... 2014-169132

(51) Int. Cl.
*B41J 2/165* (2006.01)

(52) U.S. Cl.
CPC ..... *B41J 2/16523* (2013.01); *B41J 2/1652* (2013.01); *B41J 2/16508* (2013.01)

(58) Field of Classification Search
None
See application file for complete search history.

(56) References Cited

U.S. PATENT DOCUMENTS

| | | | | |
|---|---|---|---|---|
| 6,402,293 | B1 | 6/2002 | Sawicki | |
| 2007/0247486 | A1 | 10/2007 | Sakurai | |
| 2008/0143779 | A1 | 6/2008 | Yoshida | |
| 2010/0118082 | A1 | 5/2010 | Tojo | |
| 2014/0292906 | A1* | 10/2014 | Hayashi | B41J 2/16532 347/23 |

FOREIGN PATENT DOCUMENTS

| | | | |
|---|---|---|---|
| CN | 101734016 | A | 6/2010 |
| JP | 2002-019149 | A | 1/2002 |
| JP | 2006-142630 | A | 6/2006 |
| JP | 2009-113410 | A | 5/2009 |
| JP | 2009-285868 | A | 12/2009 |
| JP | 2010-105272 | A | 5/2010 |

* cited by examiner

*Primary Examiner* — Justin Seo

(57) ABSTRACT

A maintenance unit 20 of a printer 1 has a waste ink recovery tank 24 that recovers waste ink. First and second mixing tubes 22A and 22B connect to the waste ink recovery tank 24. One mixing tube 22A branches into a tube BK and a tube Y, and the second mixing tube 22B branches into a tube C and a tube M. Black ink BK and yellow ink Y are merged and mixed in first mixing tube 22A before entering the waste ink recovery tank 24. The mixed inks from both mixing tubes then mix and flow together through a flow path 33 in the waste ink recovery tank 24. As a result, the chance of the ink inlets to the waste ink recovery tank becoming clogged by ink that has increased in viscosity can be reduced.

20 Claims, 7 Drawing Sheets

WASTE INK RECOVERY UNIT, PRINTER, AND WASTE INK RECOVERY METHOD

BACKGROUND

1. Technical Field

The present invention relates to a waste ink recovery unit, a printer, and a waste ink recovery method for recovering ink from an inkjet head into a waste ink tank.

2. Related Art

Inkjet printers are one type of fluid ejection device that ejects fluid from the nozzles of a fluid ejection head. To prevent the nozzles from becoming clogged as a result of ink in the nozzles increasing in viscosity, inkjet printers may execute a flushing operation that regularly ejects ink from the nozzles into a cap covering the nozzle face, or an ink suction operation that covers the nozzle face with a cap and forcibly removes ink from the nozzles into the cap by means of suction, for example. JP-A-2006-142630 discloses such an inkjet printer.

The inkjet printer disclosed in JP-A-2006-142630 recovers ink ejected into the cap through a tube (suction path) into a waste ink tank (waste ink recovery tank). The waste ink tank is removably installed to a tank holding unit of the inkjet printer. The waste ink tank has a box-like container and a cover, and an ink sponge made of non-woven cloth, for example, is disposed in layers inside the tank. A tube that carries the ink into the tank is attached to the back side of the cover, and the distal end of the tube extends to the middle of the tank. A channel through which the tube passes is formed in the top sponge layer. A hole in the ink sponge is formed around the inside distal end of the tube. The waste ink is thus ejected through this center hole and absorbed by the ink sponge.

Inkjet printers that eject plural different types (such as colors) of inks may have an inkjet head and a cap for each ink, and a suction path is connected to each cap. In the inkjet printer disclosed in JP-A-2006-142630, plural tubes (suction paths) lead into the waste ink tank, and the distal end openings of the tubes go to different positions. The type of colorant, and the amount of glycerin and water in the ink differs according to the type of ink, and the different inks increase in viscosity at different rates.

When the entry point (distal end opening of the tube) to the waste ink tank differs according to the type of ink as disclosed in JP-A-2006-142630, ink that easily increases in viscosity cannot easily mix with the other inks. As a result, ink that easily increases in viscosity gradually accretes, and the distal end opening of the tube may become plugged. If the distal end of the tube becomes plugged, pressure builds up in the tube as the suction pump drives. This can result in the connection disconnecting and ink leaking.

SUMMARY

The present invention is directed to this problem, and reduces the chance of the entrance of ink to the waste ink tank becoming blocked by ink that easily increases in viscosity.

A first aspect of the invention is a waste ink recovery unit including: a waste ink recovery tank; a first mixing tube connected to a first waste ink inlet of the waste ink recovery tank; a first cap covering an ink nozzle face of a first head unit that ejects ink; a second cap covering a ink nozzle face of a second head unit that ejects a different ink than the first head unit; a first tube that connects the first cap and the first mixing tube; a second tube that connects the second cap and the first mixing tube; and a first suction pump that suctions fluid from the first cap and the second cap through the first mixing tube.

Thus comprised, the first tube is used to suction ink from the ink nozzles of the first head unit, and the second tube is used for suctioning ink from the ink nozzles of the second head unit. The two suctioned inks are merge into a mixing tube (first mixing tube), and are suctioned simultaneously by driving a common suction pump (first suction pump). Ink ejected by the first head unit and ink ejected by the second head unit can therefore be mixed in the first mixing tube. When recovering ink of a type that easily increases in viscosity as waste ink, the chance of waste ink that easily increases in viscosity accumulating and the waste ink inlet becoming clogged by accreted waste ink can be reduced by thus mixing ink that easily increases in viscosity with a different ink that does not easily increase in viscosity before introducing the waste ink to the waste ink recovery tank. Problems such as pressure building up in the tubes during the ink suction operation and waste ink leaking can therefore be reduced.

A waste ink recovery unit according to another aspect of the invention also has: a second mixing tube connected to a second waste ink inlet of the waste ink recovery tank; a third cap covering an ink nozzle face of a third head unit that ejects ink; a fourth cap covering an ink nozzle face of a fourth head unit that ejects a different ink than the third head unit; a third tube that connects the third cap and the second mixing tube; a fourth tube that connects the fourth cap and the second mixing tube; and a second suction pump that is driven independently of the first suction pump, and suctions fluid from the third cap and the fourth cap through the second mixing tube.

Thus comprised, the suction channels for four types of waste ink can be separated into two channels, and each channel (i.e. each pair of waste ink) can be suctioned separately. Separating the suction channels prevents waste ink from back-flowing into another suction channel, and eliminates the need to provide a valve in each suction path and control opening and closing of the valves. Construction can therefore be simplified and suction control is simple. Waste ink that easily increases in viscosity can also be mixed with another waste ink that does not easily increase in viscosity in each of the two suction channels before entering the waste ink recovery tank.

Further preferably, when the first head unit ejects black ink, and the second head unit ejects yellow ink, the black ink and the yellow ink are mixed in the first mixing tube. When the third head unit ejects cyan ink, and the fourth head unit ejects magenta ink, the cyan ink and the magenta ink are mixed in the second mixing tube.

Thus comprised, black ink, which easily increases in viscosity, can be mixed with yellow ink, which has a lower tendency to increase in viscosity, before recovery into the waste ink recovery tank. Magenta ink, which has a higher tendency to increase in viscosity than cyan ink, is mixed with cyan ink, which has the highest water content by volume, to inhibit increasing viscosity before recovery into the waste ink recovery tank.

Further preferably, the first head unit ejects ink that has a different evaporation rate than the ink ejected by the second head unit. More specifically, the first head unit ejects ink that has a lower percentage pigment by volume than the ink ejected by the second head unit. Alternatively, the first head unit ejects ink that contains more water by volume than the ink ejected by the second head unit.

In a waste ink recovery unit according to another aspect of the invention, the waste ink recovery tank has a flow path through which flows first mixed ink introduced from the first waste ink inlet to the waste ink storage space in the waste ink recovery tank, and second mixed ink introduced from the second waste ink inlet to the waste ink storage space; and a mixing unit that mixes the first mixed ink and the second mixed ink at one place between the first waste ink inlet and the second waste ink inlet and the bottom of the waste ink storage space is disposed to the flow path.

Thus comprised, waste ink (mixed ink) introduced from the first and second waste ink inlets can thus be mixed before flowing to the bottom of the waste ink storage space. Waste ink (mixed ink) that easily increases in viscosity can therefore be mixed with other waste ink (mixed ink) before reaching the bottom of the waste ink storage space. The chance of waste ink that easily increases in viscosity accumulating to the height of the ink inlets can therefore be further reduced, and the chance of the ink inlets becoming clogged by accreted waste ink can be further reduced.

For example, when the first mixed ink is a mixture of black ink and yellow ink, and the second mixed ink is a mixture of cyan ink and magenta ink, ink that easily increases in viscosity can be recovered into the waste ink recovery tank after being mixed with another ink to inhibit increased viscosity.

A printer according to another aspect of the invention includes the waste ink recovery unit described above, and an inkjet head including a first head unit and a second head unit.

A printer according to another aspect of the invention includes the waste ink recovery unit described above, and an inkjet head including a first head unit, a second head unit, a third head unit, and a fourth head unit.

A waste ink recovery method according to another aspect of the invention includes a first step of covering with a first cap an ink nozzle face of a first head unit that ejects ink, and covering with a second cap the ink nozzle face of a second head unit that ejects a different ink than the first head unit; and a second step of driving a first suction pump that applies suction to the inside of the first cap through a first tube to withdraw first waste ink therefrom, and applies suction to the inside of the second cap through a second tube to withdraw second waste ink therefrom, the first tube and second tube being merged into a first mixing tube, and the withdrawn first waste ink and withdrawn second waste ink being combined into a first mixed ink in the first mixing tube, and a third step of recovering the first mixed ink from a first waste ink inlet into a waste ink recovery tank.

In a waste ink recovery method according to another aspect of the invention, the first step includes covering with a third cap an ink nozzle face of a third head unit that ejects ink, and covering with a fourth cap an ink nozzle face of a fourth head unit that ejects a different ink than the third head unit; and the second step includes driving a second suction pump independent of the first pump to apply suction to the inside of the third cap through a third tube to withdraw third waste ink therefrom, and applying suction to the inside of the fourth cap through a fourth tube to withdraw fourth waste ink therefrom, the third tube and fourth tube being merged into a second mixing tube, and the withdrawn third waste ink and withdrawn fourth waste ink being combined into a second mixed ink in the second mixing tube, and a third step of recovering second mixed ink from a second waste ink inlet into the waste ink recovery tank.

A waste ink recovery method according to another aspect of the invention preferably also has a fourth step following the third step, the fourth step including mixing the first mixed ink introduced from the first waste ink inlet with the second mixed ink introduced from the second waste ink inlet at one place between the first waste ink inlet and second waste ink inlet and the bottom of the waste ink storage space inside the waste ink recovery tank.

In this waste ink recovery method, the first head unit preferably ejects ink that has a different evaporation rate than the ink ejected by the second head unit. More specifically, the first head unit ejects ink that has a lower percentage pigment by volume than the ink ejected by the second head unit. Alternatively, the first head unit ejects ink that contains more water by volume than the ink ejected by the second head unit.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet printer having the waste ink tank and waste ink recovery unit according to the invention is described below with reference to the accompanying figures.

General Configuration

Figure 1:
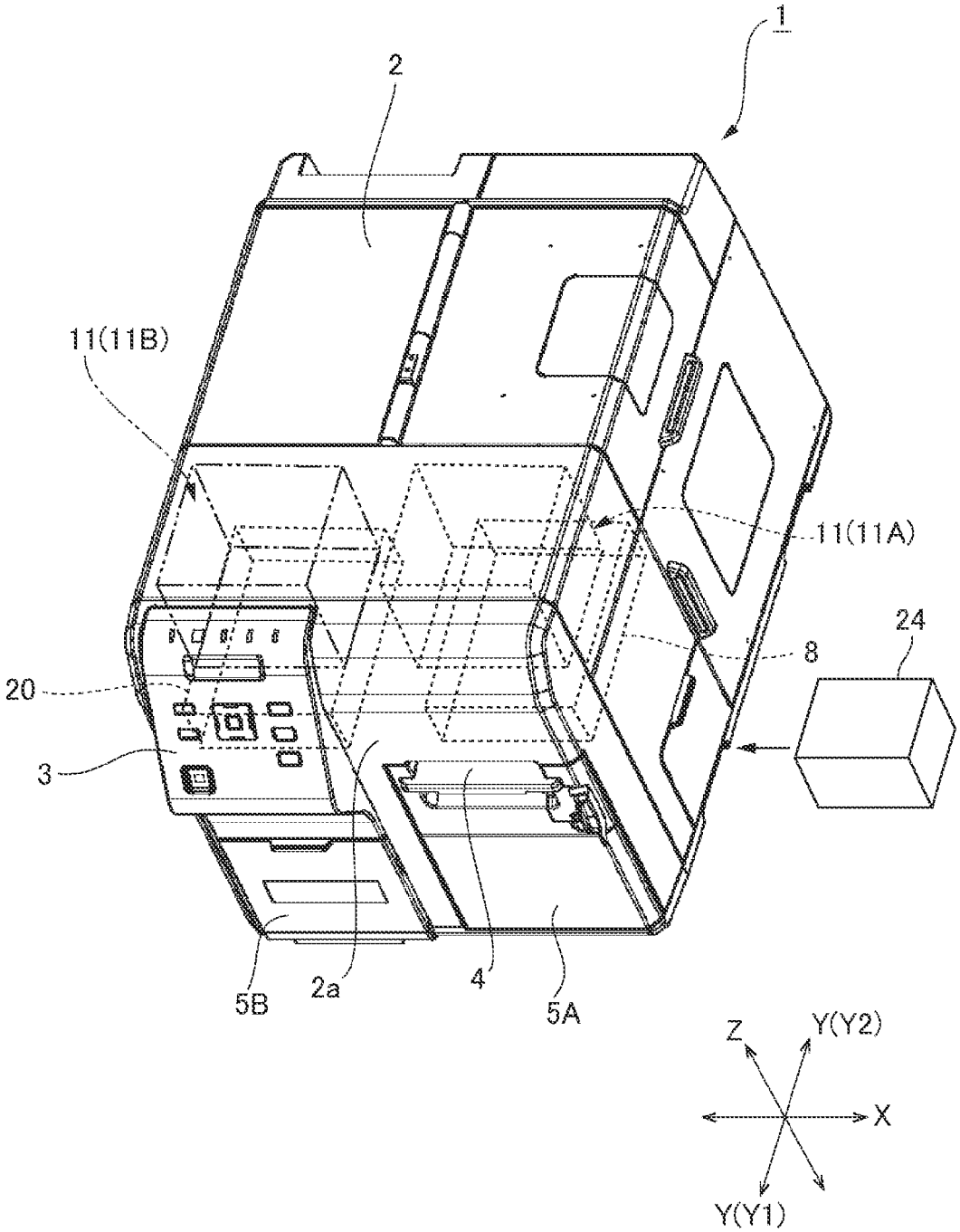
FIG. 1 is an external oblique view of an inkjet printer according to the invention.
Figure 2:
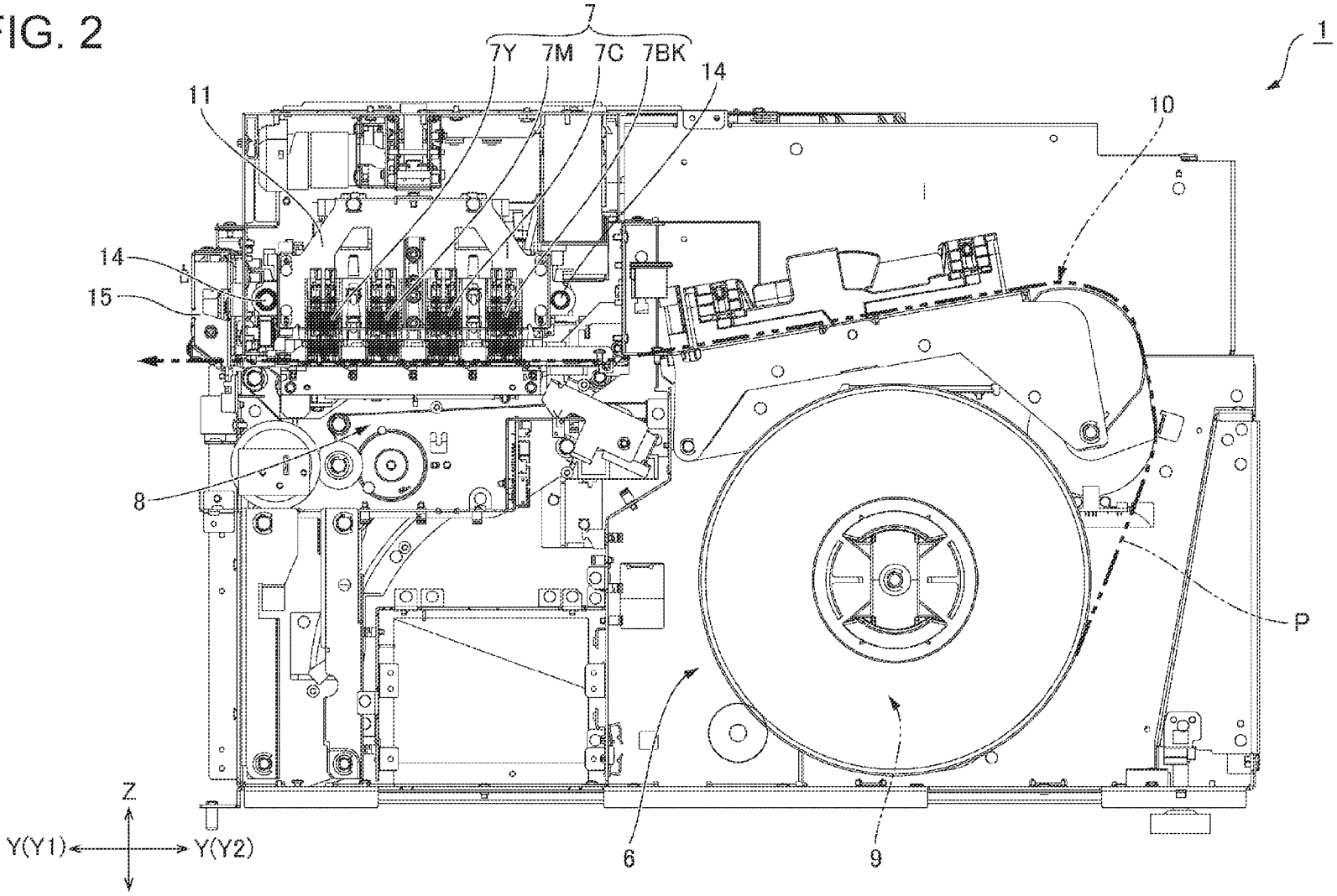
FIG. 2 is a vertical section view of the printer shown in FIG. 1.

FIG. 1 is an external oblique view of an inkjet printer according to the invention, FIG. 2 is a vertical section view showing the internal configuration of the printer. Below, the transverse axis widthwise to the printer case is the X-axis, the longitudinal axis between the front and back of the printer is the Y-axis, and the vertical axis is the Z-axis. The three axes X, Y, Z are perpendicular to each other. In addition, Y1 denotes a direction toward the front of the printer and Y2 denotes a direction toward the back of the printer along the longitudinal axis Y. As shown in FIG. 1, the inkjet printer 1 (printer 1 below) has a printer cabinet 2 that is basically box-shaped and is long from front to back, and a waste ink recovery tank 24 removably installed in the printer cabinet 2. The waste ink recovery tank 24 is described in detail below.

An operating panel 3 is disposed at the top of the front 2*a* of the printer cabinet 2 on one side of the transverse axis X, and a paper exit 4 is formed on the other side. An access cover 5A is disposed below the paper exit 4. Opening the access cover 5A exposes the media conveyance path 10 inside the printer (see FIG. 2). Below the operating panel 3 is another access cover 5B that opens and closes the ink cartridge loading unit (not shown in the figure). Four ink cartridges (not shown in the figure) storing four colors of ink, black ink BK, cyan ink C, magenta ink M, and yellow ink Y, are installed in the ink cartridge loading unit.

As shown in FIG. 2, a roll paper compartment 6 is formed at the bottom at the back Y2 inside the printer cabinet 2. An inkjet head 7 is disposed at the top of the printer toward the front Y1, and a platen unit 8 is disposed below the inkjet head 7 toward the front Y1. Continuous recording paper P pulled from a paper roll 9 and loaded in the roll paper compartment 6 is conveyed through a media conveyance path 10 indicated by an imaginary line, passes the print position of the inkjet head 7, and is discharged from the paper exit 4.

The inkjet head 7 is an inkjet line head, and includes four head units, head unit 7BK, head unit 7C, head unit 7M, and head unit 7Y. Each of these four head units is long and narrow on the transverse axis X, and are disposed with a specific gap therebetween on the longitudinal axis Y. Ink nozzles that eject black ink BK are formed in head unit 7BK. Ink nozzles that eject cyan ink C are formed in head unit 7C. Ink nozzles that eject magenta ink M are formed in head unit 7M. Ink nozzles that eject yellow ink Y are formed head unit 7Y.

The inkjet head 7 is mounted on a carriage 11. The carriage 11 is supported movably on the transverse axis X by a pair of carriage guide rails 14 extending parallel to the transverse axis X. The carriage 11 moves between an opposing position 11A opposite the platen as denoted by the dotted line in FIG. 1, and a standby position 11B denoted by the double-dot dash line in FIG. 1, by means of a carriage moving mechanism 15 disposed at the printer front Y1. When the carriage 11 is at the opposing position 11A, the inkjet head 7 mounted on the carriage 11 is opposite the platen 8. When the carriage 11 is at the standby position 11B, the inkjet head 7 is opposite the maintenance unit 20 disposed therebelow.

Waste Ink Recovery Unit

Figure 3:
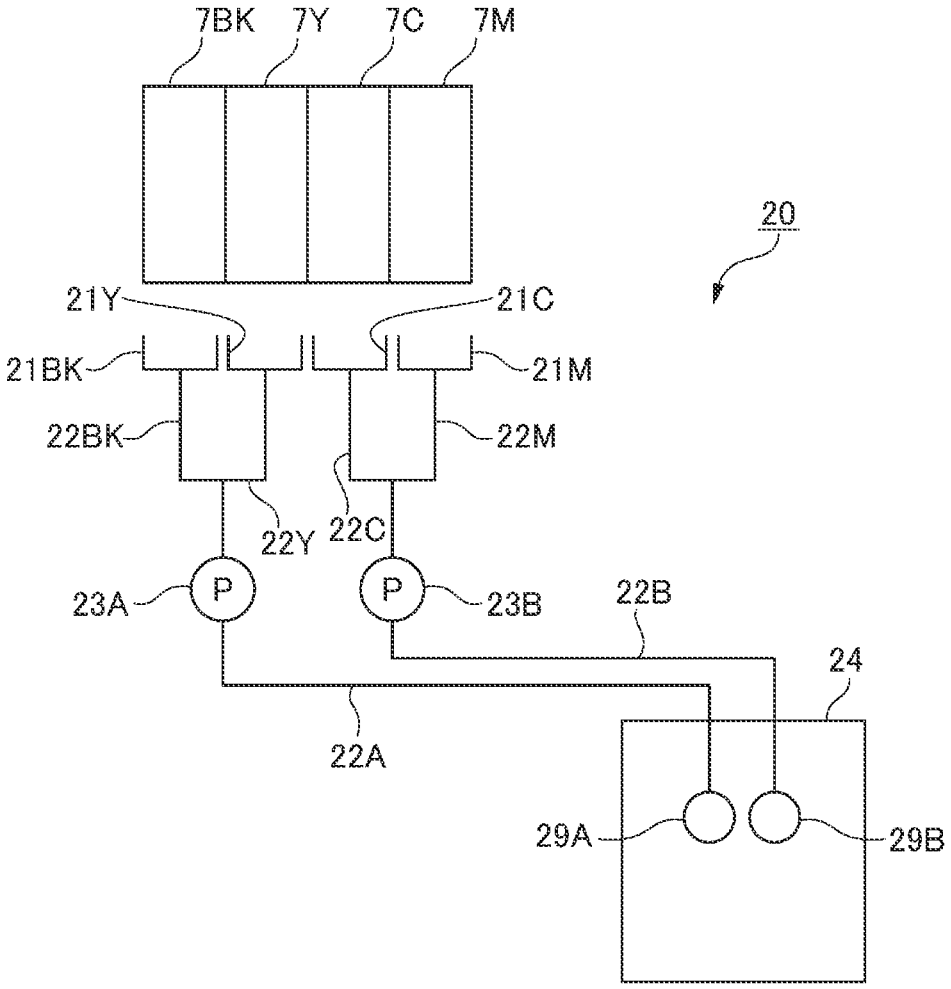
FIG. 3 illustrates the waste ink recovery path through which waste ink is recovered.

FIG. 3 illustrates the waste ink recovery system for recovering waste ink. The maintenance unit 20 (waste ink recovery unit) includes box-like head caps 21BK, 21C, 21M, 21Y, tubes 22BK, 22C, 22M, 22Y, suction pumps 23A, 23B, waste ink recovery tank 24. The printer 1 performs flushing and ink suction operations to prevent or resolve clogging caused by increased viscosity of the ink in the ink nozzles of the inkjet head 7.

In the flushing operation, the printer 1 moves the inkjet head 7 (i.e. 7BK, 7Y, 7C, and/or 7M) to the standby position 11B and ejects ink into the head cap 21. In the ink suction operation, the printer 1 covers the nozzle face to the inkjet head 7 with the corresponding head cap 21 (i.e. 21BK, 21Y, 21C, and/or 21M), and suctions ink from the nozzles into the head cap 21. Ink ejected by the flushing operation is absorbed by an ink sponge (not shown in the figure) disposed inside the respective head cap 21BK, 21C, 21M, 21Y. In the ink suction operation, the ink held inside the head caps 21BK, 21C, 21M, 21Y is recovered through the corresponding tubes 22BK, 22C, 22M, 22Y into the waste ink recovery tank 24. Because a negative pressure is created in the ink suction operation inside the head caps 21BK, 21C, 21M, 21Y, ink inside the ink nozzles is suctioned and recovered into the waste ink recovery tank 24.

When the inkjet head 7 is at the standby position 11B, head cap 21BK (first cap) is opposite the ink nozzle face of head unit 7BK (first head unit); head cap 21C (third cap) is opposite the ink nozzle face of head unit 7C (third head unit); head cap 21Y (second cap) is opposite the ink nozzle face of head unit 7Y (second head unit); and head cap 21M (fourth cap) is opposite the ink nozzle face of head unit 7M (fourth head unit).

The maintenance unit 20 also has a lift mechanism (not shown in the figure) that moves the head caps 21BK, 21C, 21M, 21Y on the vertical axis Z. For the ink suction operation and when the inkjet head 7 enters the standby mode, the maintenance unit 20 raises the head caps 21BK, 21C, 21M, 21Y and caps the ink nozzle face of each head unit.

The maintenance unit 20 suctions the four colors of ink, black ink BK, cyan ink C, magenta ink M, and yellow ink Y, through two channels by means of two suction pumps 23A, 23B. More specifically, one end of tube 22A (first mixing tube) is connected to the waste ink recovery tank 24, and the other end branches into tube 22BK (first tube) and tube 22Y (second tube). Tube 22BK connects to head cap 21BK, and tube 22Y connects to head cap 21Y. Suction pump 23A (first suction pump) is connected in the suction path of tube 22A.

Likewise, one end of tube 22B (second mixing tube) is connected to the waste ink recovery tank 24, and the other end branches into tube 22C (third tube) and tube 22M (fourth tube). Tube 22C connects to head cap 21C, and tube 22M connects to head cap 21M. Suction pump 23B (second suction pump) is connected to tube 22B.

The waste ink recovery process of the maintenance unit 20 is described below.

In a first step, the inkjet head 7 moves to the standby position 11B, and the ink nozzle faces of head units 7BK, 7Y, 7C, 7M are covered by the head caps 21BK, 21C, 21M, 21Y.

A second step is to drive suction pump 23A. This applies suction to the inside of head cap 21BK and head cap 21Y simultaneously through tubes 22BK and 22Y. As a result, black ink BK and yellow ink Y are merged and mixed through tubes 22BK and 22Y. The mixture of black ink BK and yellow ink Y (first mixed ink) is recovered through an ink inlet 30A (see part (b) in FIG. 4, described further below) into the waste ink recovery tank 24. Alternatively, only one of black ink BK and yellow ink Y is suctioned through tube 22A, and recovered from the ink inlet 30A into the waste ink recovery tank 24.

In the second step, suction pump 23A and suction pump 23B may be driven at the same time. Driving suction pump 23B suctions ink through tubes 22C, 22M from inside head cap 21C and head cap 21M. As a result, cyan ink C and magenta ink M are combined and mixed in tube 22B through tubes 22C and 22M. The mixture of cyan ink C and magenta ink M (second mixed ink) is recovered through an ink inlet 30B described further below into the waste ink recovery tank 24. Alternatively, only one of cyan ink C and magenta ink M is suctioned through tube 22B, and recovered from the ink inlet 30B (see part C in FIG. 4) into the waste ink recovery tank 24.

Driving only suction pump 23B in the second step is also possible. Suction pump 23B and suction pump 23A can also be independently driven. As a result, suction can be applied to only one of the two suction paths.

When suction pumps 23A and 23B are driven at the same time, the second step is followed by a third step that mixes the two different waste inks (such as the first and second mixed inks) introduced to the waste ink recovery tank 24 from the tubes 22A and 22B before the waste ink reaches the bottom of the waste ink recovery tank 24. As described further below, the third step occurs when the waste ink flows into a flow path 33 (see FIG. 5) inside the waste ink recovery tank 24.

Waste Ink Recovery Tank

Figure 4:
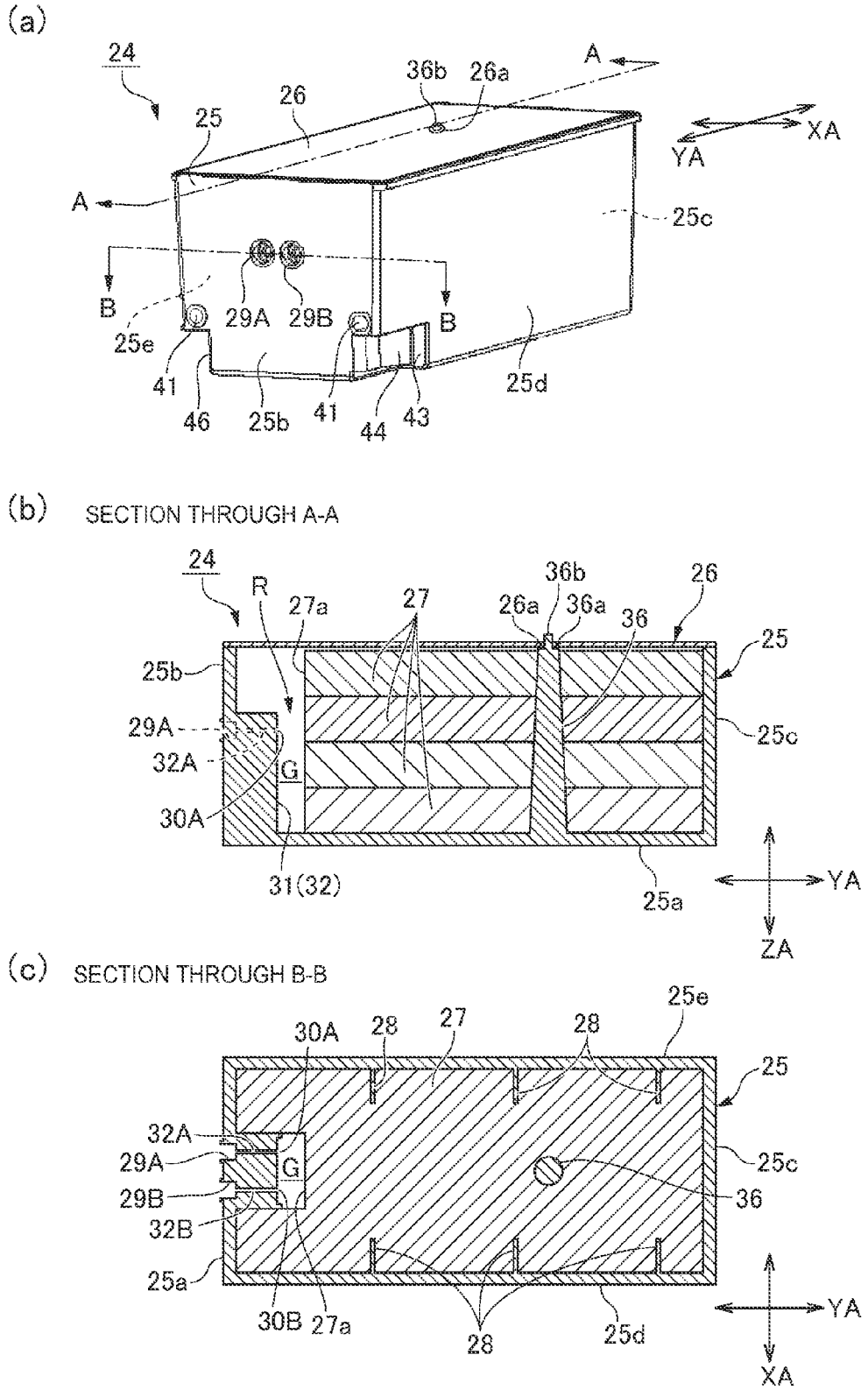
FIG. 4 illustrates the waste ink tank.

FIG. 4 illustrates the waste ink recovery tank 24, part (a) being an external oblique view, and parts (b) and (c) being section views through lines A-A and B-B in part (a), respectively. As shown in the figures, the waste ink recovery tank 24 has a box-like housing 25, a flexible film 26 covering the top opening to the housing 25, and a porous ink sponge 27 that absorbs waste ink.

The housing 25 has a rectangular bottom 25*a* forming the bottom of the tank, a front wall 25*b* and a back wall 25*c* rising from the two shorter sides of the bottom 25*a*, and side walls 25*d* and 25*e* rising from the two long sides of the bottom 25*a*. Below, the direction between the side walls 25*d* and 25*e* (widthwise direction of the tank) is denoted XA, and the direction between the front wall 25*b* and back wall 25*c* (the lengthwise direction of the tank) is denoted YA. The tank width direction XA and the tank length direction YA are perpendicular to each other.

A waste ink storage space R is formed inside the housing 25 surrounded by the bottom 25*a*, front wall 25*b*, back wall 25*c*, and side walls 25*d* and 25*e*. A plurality of vertical ribs 28 protruding to the inside of the waste ink storage space R are formed on side wall 25*d*. The plural vertical ribs 28 are disposed at a regular interval on the tank length direction YA. A plurality of vertical ribs 28 are also formed on the side wall 25*e* opposite the vertical ribs 28 on the other side wall 25*d*. The ink sponge 27 is built in layers inside the waste ink storage space R.

Figure 5:
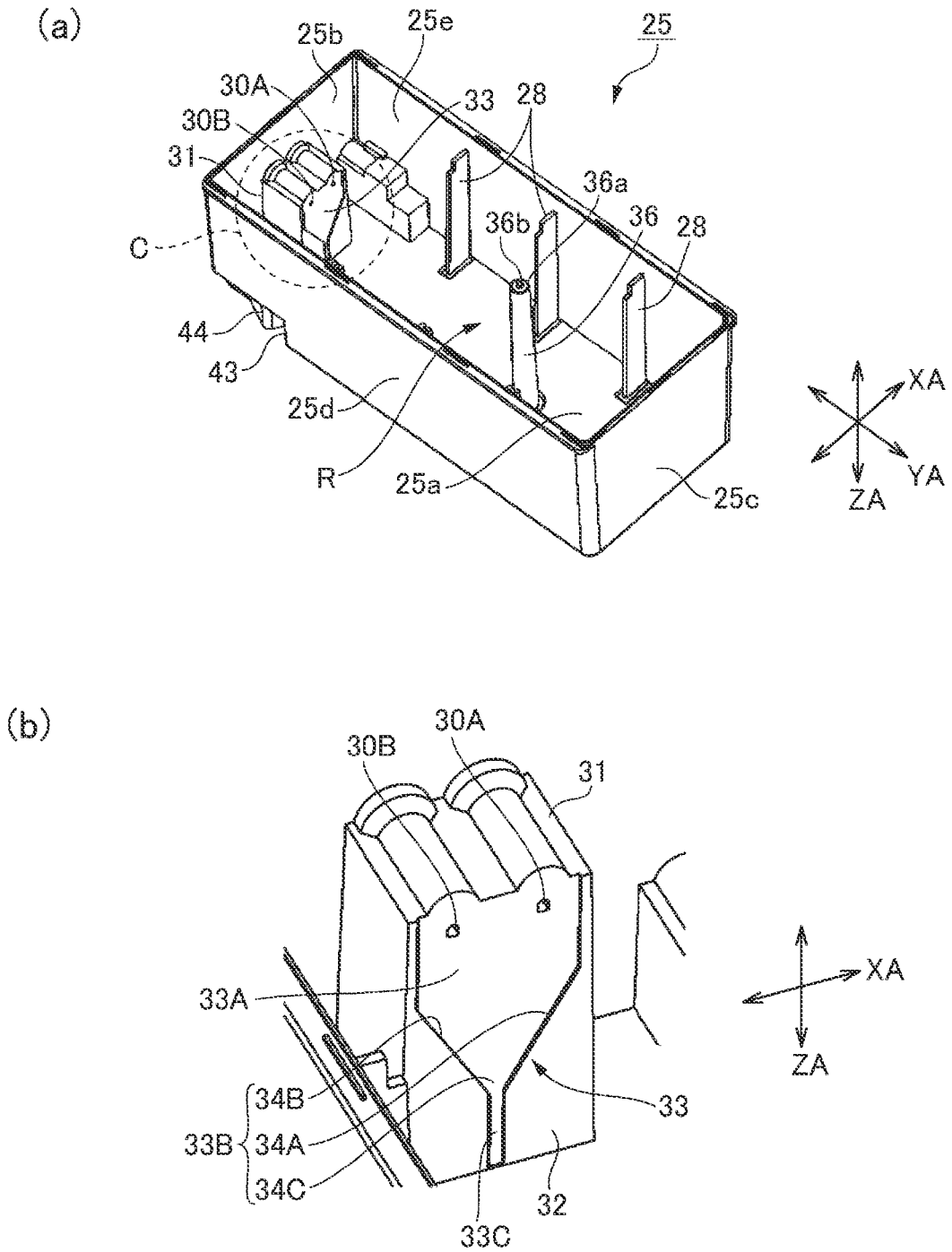
FIG. 5 illustrates the case of the waste ink tank.

FIG. 5 illustrates the housing 25 of the waste ink recovery tank 24, part (a) of FIG. 5 being an oblique view, and part (b) being an enlarged view of the area indicated by the circle C in part (a). As shown in FIG. 4, the two tube inlets 29A and 29B are opened in the side of the front wall 25*b* facing the outside, and as shown in FIG. 5, tube inlets 29A and 29B lead to tube inlet 30A and 30B, respectively, which are opened to the inside of housing 25. A riser 31 is formed in unison with the inside side of the front wall 25*b* in the middle of the width of the front wall 25*b*. Two through-holes 32A, 32B (shown in FIG. 4) are formed in the top part of the riser 31 passing through in the tank length direction YA. The tube inlets 29A and 29B are disposed to one end of the through-holes 32A, 32B. The other ends of the through-holes 32A, 32B open to the inside of the housing 25, embodying the ink inlets 30A and 30B. The end of tube 22A into which tube 22Y and tube 22BK merge can connect to the tube inlet 29A. The end of tube 22B into which tube 22M and tube 22C merge can connect to the tube inlet 29B.

Suctioned waste ink passes through tubes 22A and 22B and is introduced to the through-holes 32A, 32B. The waste ink passes from the through-holes 32A, 32B through the ink inlets 30A and 30B and into the waste ink storage space R.

The front of the riser 31 is the inside wall of the housing 25. Below, the portion of the riser 31 opposite the back wall 25*c* is referred to as the inside surface 32. The ink inlets 30A and 30B are open at the top of the inside surface 32. The ink inlets 30A and 30B are at the same height from the bottom 25*a*. The ink inlets 30A and 30B are also disposed with a specific distance therebetween in the tank width direction XA. Note that the tank width direction XA is perpendicular to the direction of ink descent ZA (see FIG. 5, part (b)), the direction in which waste ink flows inside the waste ink tank. When the waste ink recovery tank 24 is installed to the printer cabinet 2, the direction of ink descent ZA is perpendicular to the tank width direction XA and the tank length direction YA.

Ink Path

As shown in FIG. 5 (*b*), a flow path 33 through which ink introduced from the ink inlets 30A and 30B flows is formed on the inside surface 32. The flow path 33 is a recessed portion of a constant depth formed on the inside surface 32, and is basically Y-shaped when seen in plain view.

The flow path 33 includes an upper channel 33A of a constant width at the top of the inside surface 32, an inclined channel 33B (inclined part) connected to the bottom of the upper channel 33A, and a bottom channel 33C connected to the bottom of the inclined channel 33B. The bottom channel 33C is narrower than the upper channel 33A.

The upper channel 33A is formed with a width including the area where the ink inlets 30A and 30B are disposed. The inclined channel 33B includes a first inclined path 34A disposed on the direction of ink descent ZA below the ink inlet 30A, and a second inclined path 34B disposed below the ink inlet 30B on the direction of ink descent ZA. The first and second inclined paths 34A, 34B slope at the same angle from opposite directions toward the direction of ink descent ZA. As a result, a mixing channel 34C where the first and second inclined paths 34A, 34B come together is disposed to the bottom end of the inclined channel 33B. The bottom channel 33C extends from the mixing channel 34C in the direction of ink descent ZA to the bottom 25*a*.

When suction pump 23A is driven, waste ink that is the black ink BK (first waste ink), the yellow ink Y (second waste ink), or a combination of both (first mixed ink), is introduced to the ink inlet 30A. Waste ink from the ink inlet 30A flows down at an angle along the first inclined path 34A to the mixing channel 34C.

When suction pump 23B is driven, waste ink that is the cyan ink C (third waste ink) from tube 22C, the magenta ink M (fourth waste ink), or a combination of both (second mixed ink), is introduced to the ink inlet 30B. Waste ink from the ink inlet 30B flows down at an angle along the second inclined path 34B to the mixing channel 34C.

The mixing channel 34C is thus where waste ink introduced from ink inlet 30A and waste ink introduced from ink inlet 30B is mixed at one place. The waste ink combined at the mixing channel 34C mixes as it flows down through the bottom channel 33C, and flows into the bottom of the waste ink storage space R.

As shown in FIG. 4 parts (b) and (c), a notch 27*a* accommodating the riser 31 is formed in the ink sponge 27 in the waste ink storage space R. This notch 27*a* is deeper than the amount that the riser 31 protrudes from wall 25*b*. As a result, a gap G is formed between the inside surface 32 and the ink sponge 27. By thus disposing the ink sponge 27 with a gap G to the inside surface 32, the first waste ink and the second waste ink introduced from the ink inlets 30A and 30B is mixed as it flows down through the flow path 33 without contact with the ink sponge 27 interfering with the ink mixing. The mixed ink that reaches the bottom of the waste ink storage space R then contacts the ink sponge 27 and lifted up by absorption, and is held by the ink sponge 27.

The four different inks ejected by the inkjet head 7 evaporate and increase in viscosity at different rates due to differences in their compositions. More specifically, black ink BK is 5% pigment (such as carbon black) by volume, yellow ink Y is 6% pigment (such as azo compounds) by volume, cyan ink C is 4% pigment (such as phthalocyanine compounds) by volume, and magenta ink M is 6% pigment (such as quinacridone compounds) by volume. Of these four inks, magenta ink M increases in viscosity the easiest. Because cyan ink C contains more water than the other inks, it is less susceptible to increased viscosity, and when mixed with other inks disperses the pigment and inhibits increasing in viscosity.

Therefore, mixing cyan ink C and magenta ink M in tube 22B and then introducing the mixed ink as the waste ink from the ink inlet 30B to the waste ink storage space R can reduce the chance of waste ink accreting and eventually blocking the ink inlets 30A and 30B, which can happen when waste ink that increases easily in viscosity flows by itself to the bottom of the waste ink tank.

The viscosity of black ink BK and yellow ink Y also increases at different rates. Therefore, mixing black ink BK and yellow ink Y in tube 22A and then introducing the mixed ink as the waste ink from the ink inlet 30A to the waste ink storage space R can reduce the chance of waste ink accreting and eventually blocking the ink inlets 30A and 30B, which can happen when waste ink that increases easily in viscosity flows by itself to the bottom of the waste ink tank.

When waste ink flows in from both ink inlets 30A and 30B in this embodiment, the two types of waste ink are mixed in the flow path 33. In this event, waste ink including magenta ink M mixes with other inks more resistance to increased viscosity as it flows to the bottom of the waste ink tank. Accretion of waste ink on the bottom of the container, and the chance of ink inlets 30A and 30B becoming clogged, can therefore be reduced.

Air Valve

As shown in FIG. 4 and FIG. 5, a valve column 36 (protrusion) is formed in the housing 25 projecting from the bottom 25*a* to the film 26 side. An air hole 26*a* is formed in the film 26 at a position matching the distal end of the valve column 36. The distal end of the valve column 36 and the air hole 26*a* embody an air valve 37. More specifically, the distal end face 36*a* of the valve column 36 is a round, flat surface larger in diameter than the air hole 26*a*, and the valve body 36*b* protrudes from the center.

As shown in FIG. 4 (*b*), the air valve 37 is closed when the valve body 36*b* is in the air hole 26*a*, and the edge of the air hole 26*a* opening in the film 26 is in contact with the distal end face 36*a* of the valve column 36. When waste ink is introduced and the internal pressure of the waste ink recovery tank 24 increases, the flexible film 26 rises. As a result, the valve body 36*b* exits the air hole 26*a*, and a gap is formed between the edge of the air hole 26*a* opening in the film 26 and the distal end face 36*a* of the valve column 36. The air valve 37 is therefore open. When air escapes and the internal pressure drops, the film 26 returns to its original position, and the air valve 37 closes. Air is thus appropriately vented by the air valve 37 when waste ink is introduced to the waste ink recovery tank 24.

Structure for Installing Waste Ink Tank to Printer

Figure 6:
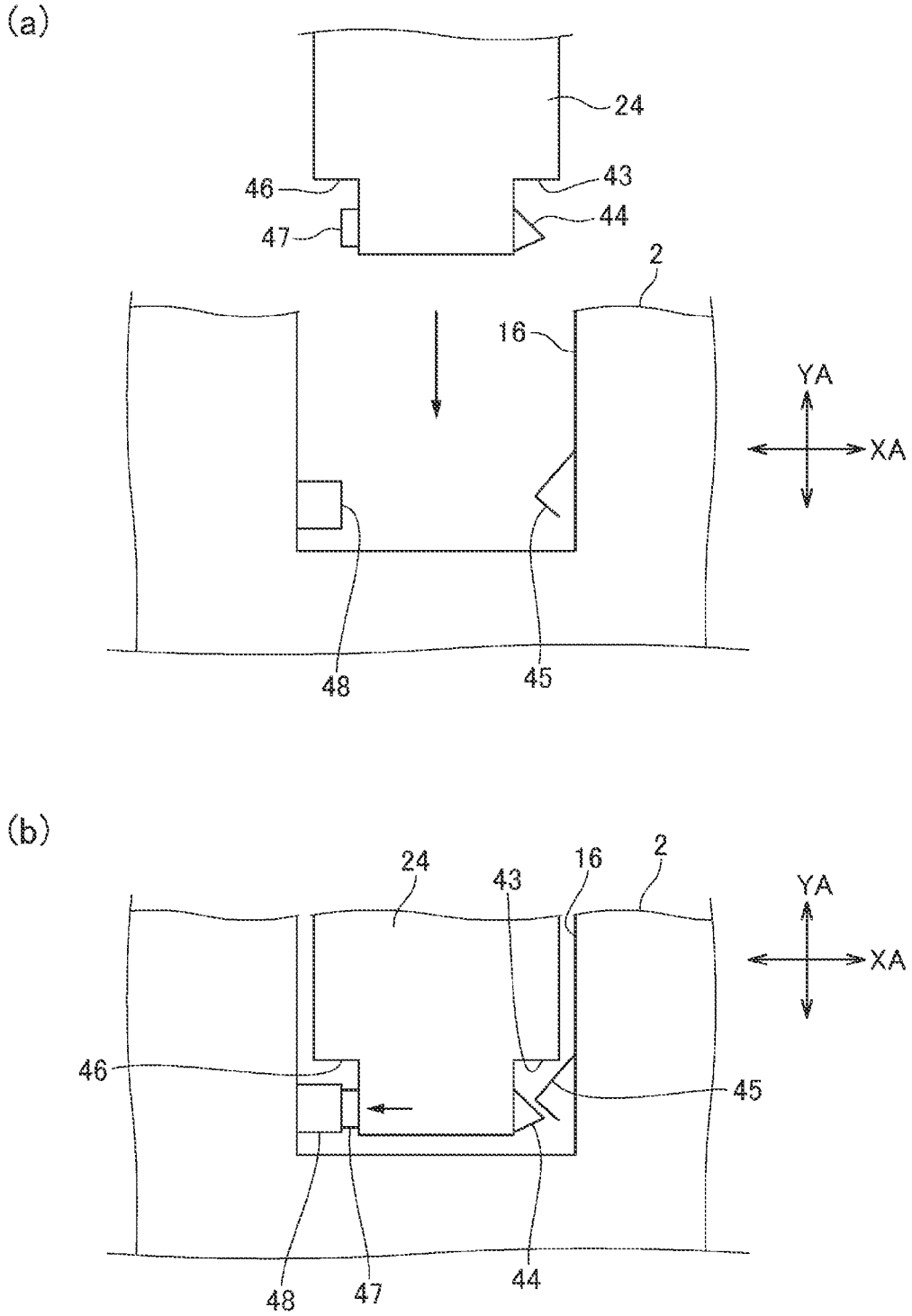
FIG. 6 schematically illustrates the configuration for removably installing the waste ink tank in the printer.

FIG. 6 illustrates the construction for removably installing the waste ink recovery tank 24 in the printer cabinet 2, part (a) shows when the waste ink recovery tank 24 is not installed and part (b) shows when the waste ink recovery tank 24 is installed. As described above, the waste ink recovery tank 24 is removably installed in a printer cabinet 2 with an inkjet head 7 (see FIG. 1). A recovery tank loading unit 16 (see FIG. 6) is disposed in the printer cabinet 2. The recovery tank loading unit 16 is disposed to a position beside the roll paper compartment 6 on the transverse axis X, but may be disposed to a different position. As shown in FIG. 6, the recovery tank loading unit 16 is a recessed space formed in the printer cabinet 2.

The waste ink recovery tank 24 is installed with the front wall 25*b* of the housing 25 facing the inside of the recovery tank loading unit 16. More specifically, the direction from the back wall 25*c* to the front wall 25*b* (one side on the tank length direction YA) is the direction in which the waste ink recovery tank 24 installs. Two positioning holes 41 (see FIG. 4, part (a)) are formed in the outside side of the front wall 25*b*. The two positioning holes 41 are on opposite sides of the front wall 25*b* in the tank width direction XA. Positioning pins (not shown in the figure) protrude from the recovery tank loading unit 16 at position matching the positioning holes 41. When the waste ink recovery tank 24 is inserted to the recovery tank loading unit 16, the positioning pins are inserted to the positioning holes 41 and guide the waste ink recovery tank 24 to the installed position.

As shown in FIG. 4 (*a*), a recess 43 is formed in the housing 25 of the waste ink recovery tank 24 on the outside side (first container side) of the side wall 25*d* on one side of the tank width direction XA. This recess 43 is located at the bottom corner where the side wall 25*d* and front wall 25*b* meet, and one positioning hole 41 is located at the top of the recess 43. A key 44 is disposed in this recess 43. The key 44 protrudes to the outside on the tank width direction XA. as shown in FIG. 6, a lock spring 45 is disposed in the recovery tank loading unit 16 at a position opposite the key 44 on the tank width direction XA. When the waste ink recovery tank 24 is installed to the recovery tank loading unit 16, the key 44 engages the lock spring 45.

As shown in FIG. 4 (*a*), a recess 46 is also formed on the outside side (second container side) of the side wall 25*e* on the other side of the tank width direction XA. This recess 46 is located at the bottom corner where the side wall 25*e* and front wall 25*b* meet, and the other positioning hole 41 is located at the top of the recess 46. As shown in FIG. 6, a CSIC (customer service integrated circuit) 47 is disposed in this recess 46. The CSIC 47 is a memory device that stores how much waste ink is in the waste ink recovery tank 24, for example. A CSIC connector 48 is disposed to the recovery tank loading unit 16 at a position opposite the CSIC 47 on the tank width direction XA.

When the waste ink recovery tank 24 is installed to the recovery tank loading unit 16, the contact of the CSIC 47 and the contact of the CSIC connector 48 connect, and data can be read and written to the CSIC 47. The lock spring 45 that engages the key 44 pushes the waste ink recovery tank 24 to the CSIC connector 48 side through the key 44. As a result, the CSIC 47 is pushed against the CSIC connector 48, and contact therebetween is maintained.

More specifically, the locking mechanism that engages the waste ink recovery tank 24 in the recovery tank loading unit 16 also functions to prevent poor contact between the CSIC 47 and CSIC connector 48.

Effect

As described above, the tube 22Bk through which ink is suctioned from the ink nozzles of head unit 7Bk, and the tube 22Y through which ink is suctioned from the ink nozzles of head unit 7Y, merge into tube 22A. When the common suction pump 23A is driven to suction ink from both tubes simultaneously, black ink Bk and yellow ink Y are mixed in the tube 22A.

Likewise, the tube 22C through which ink is suctioned from the ink nozzles of head unit 7C, and the tube 22M through which ink is suctioned from the ink nozzles of head unit 7M, merge into tube 22B. When the common suction pump 23B is driven to suction ink from both tubes simultaneously, cyan ink C and magenta ink M are mixed in the tube 22B.

Thus comprised, a waste ink of a type (composition) that evaporates and increases in viscosity easily can be mixed with another waste ink before entering the waste ink recovery tank 24. Accretion of waste ink that increases in viscosity easily to a height blocking the ink inlets 30A and 30B can be reduced, and the chance of the ink inlets 30A and 30B becoming clogged by accumulated waste ink can be reduced. Problems such as pressure building up in the tubes connected to the clogged ink inlets 30A and 30B during the suction operation of the maintenance unit 20, tubes failing, and waste ink leaking can also be reduced.

This embodiment of the invention groups the suction channels for four types of waste ink into two channels, and suctions ink therefrom using independent suction pumps (suction pumps 23A, 23B). Thus separating the suction channels prevents waste ink from back-flowing into another suction channel, and eliminates the need to provide a valve in each suction path and control opening and closing of the valves. Construction can therefore be simplified and suction control is simple. Waste ink that easily increases in viscosity can also be mixed with another waste ink in each of the two suction channels before entering the waste ink recovery tank, and viscosity increasing can be inhibited.

This embodiment of the invention provides ink inlets 30A and 30B for introducing different types of waste ink from two suction channels in the waste ink recovery tank 24, and merges waste ink from these two inlets at one place before the waste ink flows to the bottom of the waste ink storage space R. Waste ink of a type that easily increases in viscosity (such as the second waste ink described above) can therefore be mixed with another waste ink (such a first waste ink) before reaching the bottom of the waste ink storage space R. The chance of waste ink of a type that easily increases in viscosity accumulating to a height blocking the ink inlets 30A and 30B can therefore be reduced, and the chance of the ink inlets 30A and 30B becoming blocked by accumulated waste ink can be reduced.

Furthermore, by providing an inclined channel 33B in the flow path 33 through which the introduced waste ink flows, waste ink flowing in from different positions can be mixed in the mixing channel 34C. Waste ink introduced from plural positions can therefore be mixed by a simple configuration.

Other Embodiments (1) In the present embodiment, four types of ink are combined into two channels that are suctioned by independent suction pumps 23A, 23B, but a configuration that combines (i.e. mixes) only two of the four types of ink into a single channel and does not combine the other two types of ink so that the other two types are recovered through separate suction channels into the waste ink recovery tank 24 is also conceivable. In this event, three ink inlets are provided in the waste ink recovery tank 24, and the ink flowing in from the three inlets is mixed at one location by inclined paths. Alternatively, a configuration that mixes three or four types of ink into a single channel before recovery into the waste ink recovery tank 24 is also conceivable. Further alternatively, the number of suction channels that are mixed and the number of ink inlets can be appropriately increased or decreased according to the number of inks used when an ejection head that ejects four or more types of ink is used.

(2) The foregoing embodiment mixes different types of waste ink before entering the waste ink recovery tank 24, and mixes different types of waste ink in a flow path 33 inside the waste ink recovery tank 24. A configuration that does not have a mixing channel in the waste ink recovery tank 24, and instead guides the waste ink directly to the bottom of the waste ink tank from each of the ink inlets 30A and 30B, is also conceivable.

Figure 7:
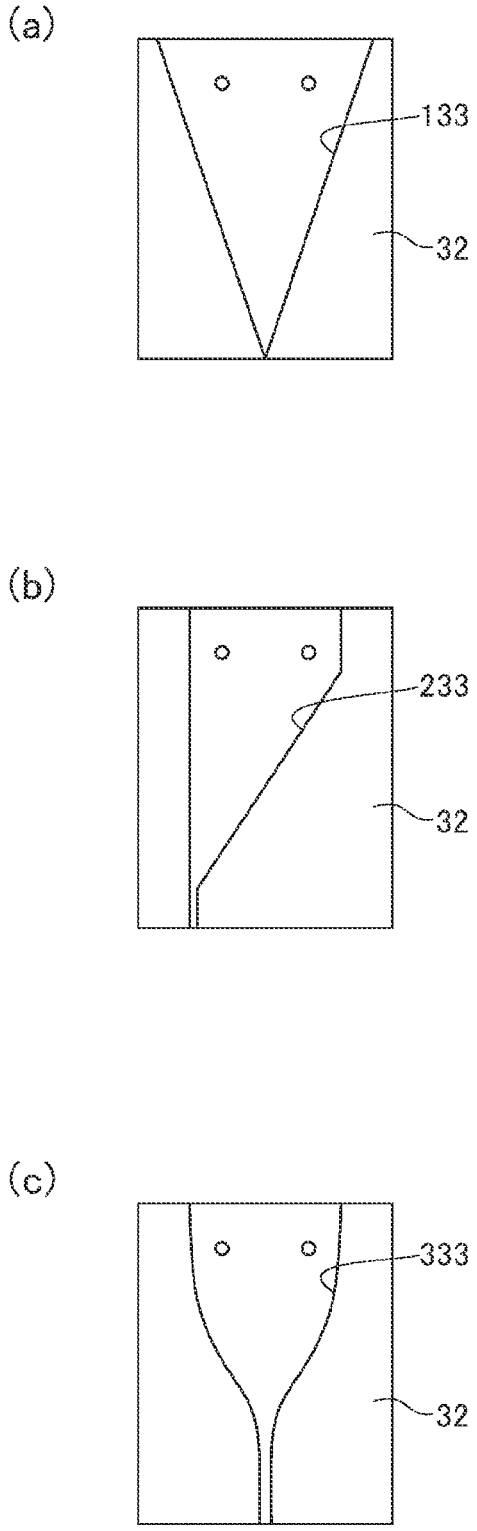
FIG. 7 illustrates a variation of the fluid path.

(3) The flow path 33 in the foregoing embodiment has an upper channel 33A of a constant width, a inclined channel 33B that narrows toward the bottom, and a bottom channel 33C that is narrower than the upper channel 33A, but the shape of the flow path 33 is not so limited. More specifically, any shape that mixes the waste ink at one location between the ink inlet and the bottom of the waste ink tank may be used. FIG. 7 shows variations of the flow path 33. In FIG. 7, part (a), the flow path 133 has sloping sides that merge at the bottom end of the flow path 133. The flow path 233 in FIG. 7, part (b) has one sloped side that merges with the other side at one widthwise side of the flow path 233. In FIG. 7, part (c), the flow path 333 has curved instead of straight sloping sides. Each of these shapes causes the waste ink introduced from different ink inlets to mix at one place. A similar effect as described above can therefore be achieved.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A waste ink recovery unit comprising:

a waste ink recovery tank;

a first mixing tube connected to a first waste ink inlet of the waste ink recovery tank;

a first cap covering a first ink nozzle that ejects ink;

a second cap covering a second ink nozzle that ejects ink;

a first tube that connects the first cap and the first mixing tube;

a second tube that connects the second cap and the first mixing tube;

a first suction pump configured to suction a first fluid from the first cap and a second fluid from the second cap, and to mix the first fluid and second fluid through the first mixing tube;

a second mixing tube connected to a second waste ink inlet of the waste ink recovery tank;

a third cap covering a third ink nozzle that ejects ink;

a fourth cap covering a fourth ink nozzle that ejects ink;

a third tube that connects the third cap and the second mixing tube;

a fourth tube that connects the fourth cap and the second mixing tube; and a second suction pump that is driven independently of the first suction pump, and is configured to suction a third fluid from the third cap and a fourth fluid from the fourth cap, and to mix the first fluid and second fluid through the second mixing tube.

2. The waste ink recovery unit described in claim 1, wherein:

the first head unit ejects black ink, and the second head unit ejects yellow ink; and the black ink and the yellow ink are mixed in the first mixing tube.

3. The waste ink recovery unit described in claim 1, wherein:

the third head unit ejects cyan ink, and the fourth head unit ejects magenta ink; and the cyan ink and the magenta ink are mixed in the second mixing tube.

4. The waste ink recovery unit described in claim 1, wherein:

the waste ink recovery tank has a flow path through which flows first mixed ink introduced from the first waste ink inlet to the waste ink storage space in the waste ink recovery tank, and second mixed ink introduced from the second waste ink inlet to the waste ink storage space; and a mixing unit configured to mix the first mixed ink and the second mixed ink at one place between the first waste ink inlet and the second waste ink inlet and the bottom of the waste ink storage space is disposed to the flow path.

5. The waste ink recovery unit described in claim 4, wherein:

the first mixed ink is a mixture of black ink and yellow ink; and the second mixed ink is a mixture of cyan ink and magenta ink.

6. The waste ink recovery unit described in claim 1, wherein:

the first head unit ejects ink that has a different evaporation rate than the ink ejected by the second head unit.

7. The waste ink recovery unit described in claim 1, wherein:

the first head unit ejects ink that has a lower percentage pigment by volume than the ink ejected by the second head unit.

8. The waste ink recovery unit described in claim 1, wherein:

the first head unit ejects ink that contains more water by volume than the ink ejected by the second head unit.

9. A printer comprising:

an inkjet head including a first ink nozzle that ejects ink and a second ink nozzle that ejects different ink than the first ink nozzle;

a first cap covering the first ink nozzle;

a second cap covering the second ink nozzle; and a waste ink recovery unit including:

a waste ink recovery tank, a first mixing tube connected to a first waste ink inlet of the waste ink recovery tank, a first tube that connects the first cap and the first mixing tube, a second tube that connects the second cap and the first mixing tube, a first suction pump configured to suction a first fluid from the first cap and a second fluid from the second cap, and to mix the first fluid and second fluid through the first mixing tube, a second mixing tube connected to a second waste ink inlet of the waste ink recovery tank, a third cap covering a third ink nozzle that ejects ink, a fourth cap covering a fourth ink nozzle that ejects different ink than the third head nozzle, a third tube that connects the third cap and the second mixing tube, a fourth tube that connects the fourth cap and the second mixing tube, and a second suction pump that is driven independently of the first suction pump, and is configured to suction a third fluid from the third cap and a fourth fluid from the fourth cap, and to mix the third fluid and fourth fluid through the second mixing tube.

10. The printer described in claim 9, wherein:

the first head unit ejects ink that has a different evaporation rate than the ink ejected by the second head unit.

11. The printer described in claim 9, wherein:

the first head unit ejects ink that has a lower percentage pigment by volume than the ink ejected by the second head unit.

12. The printer described in claim 9, wherein:

the first head unit ejects ink that contains more water by volume than the ink ejected by the second head unit.

13. A waste ink recovery method comprising:

a first step of covering with a first cap a first ink nozzle that ejects ink, and covering with a second cap a second ink nozzle that ejects a different ink than the first ink nozzle;

a second step of driving a first suction pump that applies suction to the inside of the first cap through a first tube to withdraw first waste ink therefrom, and applies suction to the inside of the second cap through a second tube to withdraw second waste ink therefrom, the first tube and second tube being merged into a first mixing tube, and the withdrawn first waste ink and withdrawn second waste ink being combined into a first mixed ink in the first mixing tube; and a third step of recovering the first mixed ink from a first waste ink inlet into a waste ink recovery tank, wherein:

the first step includes covering with a third cap a third ink nozzle, and covering with a fourth cap a fourth ink nozzle that ejects a different ink than the third ink nozzle;

the second step includes driving a second suction pump independent of the first pump to apply suction to the inside of the third cap through a third tube to withdraw third waste ink therefrom, and apply suction to the inside of the fourth cap through a fourth tube to withdraw fourth waste ink therefrom, the third tube and fourth tube being merged into a second mixing tube, and the withdrawn third waste ink and withdrawn fourth waste ink being combined into a second mixed ink in the second mixing tube; and the third step includes recovering second mixed ink from a second waste ink inlet into the waste ink recovery tank.

14. The waste ink recovery method described in claim 13, further comprising:

a fourth step after the third step, the fourth step including mixing the first mixed ink introduced from the first waste ink inlet with the second mixed ink introduced from the second waste ink inlet at one place between the first waste ink inlet and second waste ink inlet and the bottom of the waste ink storage space inside the waste ink recovery tank.

15. The waste ink recovery method described in claim 13, wherein:

the first head unit ejects ink that has a different evaporation rate than the ink ejected by the second head unit.

16. The waste ink recovery method described in claim 13, wherein:

the first head unit ejects ink that has a lower percentage pigment by volume than the ink ejected by the second head unit.

17. The waste ink recovery method described in claim 13, wherein:

the first head unit ejects ink that contains more water by volume than the ink ejected by the second head unit.

18. The waste ink recovery unit described in claim 1, wherein:

the first ink nozzle is part of a nozzle face of a first head unit that ejects first ink, the second ink nozzle is part of a nozzle face of a second head unit that ejects second ink, the third ink nozzle is part of a nozzle face of a third head unit that ejects third ink, and the fourth ink nozzle is part of a nozzle face of a fourth head unit that ejects fourth ink.

19. The printer described in claim 9, wherein:

the first ink nozzle is part of a nozzle face of a first head unit that ejects first ink, the second ink nozzle is part of a nozzle face of a second head unit that ejects second ink, the third ink nozzle is part of a nozzle face of a third head unit that ejects third ink, and the fourth ink nozzle is part of a nozzle face of a fourth head unit that ejects fourth ink.

20. The waste ink recovery method described in claim 13, wherein:

the first ink nozzle is part of a nozzle face of a first head unit that ejects first ink, the second ink nozzle is part of a nozzle face of a second head unit that ejects second ink, the third ink nozzle is part of a nozzle face of a third head unit that ejects third ink, and the fourth ink nozzle is part of a nozzle face of a fourth head unit that ejects fourth ink.

* * * * *